US006681843B2

(12) United States Patent
Sugito

(10) Patent No.: US 6,681,843 B2
(45) Date of Patent: Jan. 27, 2004

(54) COOLING APPARATUS BOILING AND CONDENSING REFRIGERANT

(75) Inventor: Hajime Sugito, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/207,327

(22) Filed: Jul. 29, 2002

(65) Prior Publication Data

US 2003/0024690 A1 Feb. 6, 2003

(30) Foreign Application Priority Data

Jul. 31, 2001 (JP) ..... 2001-231299

(51) Int. Cl.[7] ..... F28D 15/00

(52) U.S. Cl. ..... 165/104.33; 165/135; 165/104.21; 361/700; 257/715

(58) Field of Search ..... 165/185, 135, 165/136, 104.26, 104.33, 104.21; 174/15.2; 257/714, 715; 361/699, 700

(56) References Cited

U.S. PATENT DOCUMENTS 4,729,076 A * 3/1988 Masami et al. ..... 362/235
5,713,413 A 2/1998 Osakabe et al.
6,005,772 A * 12/1999 Terao et al. ..... 361/699
6,073,683 A * 6/2000 Osakabe et al. ..... 165/104.33
6,279,649 B1 * 8/2001 Osakabe ..... 165/104.33
6,341,646 B1 * 1/2002 Tanaka et al. ..... 165/104.33

FOREIGN PATENT DOCUMENTS

JP A9-205167 8/1997

* cited by examiner

*Primary Examiner*—Terrell L. McKinnon
(74) *Attorney, Agent, or Firm*—Harness, Dickey & Pierce, PLC

(57) ABSTRACT

An elongate tubular refrigerant container 2 has a barrier 5 which partitions its internal space into a heat-generating member side path 2*b* and a heat radiating path 2*c*, so that refrigerant vapor evaporated by the heat-generating member 3 is separated from the condensate that circulates after being cooled in the heat radiating section 4. The barrier 5 includes a heat insulating space 5*a* which does not communicate with the internal space 2*a* that stores a refrigerant. The refrigerant is prevented from boiling in the heat radiating section side path 2*c* and the condensate that circulates from the heat radiating section 4 and the refrigerant vapor do not collide violently with each other because the heat of the refrigerant vapor in the heat-generating member side path 2*b* is prevented from being transferred to the liquid refrigerant in the heat radiating section side path 2*c*.

8 Claims, 7 Drawing Sheets

COOLING APPARATUS BOILING AND CONDENSING REFRIGERANT

BACKGROUND OF THE INVENTION

1. Field of the Invention

The present invention relates to a cooling apparatus using latent heat of vaporization that cools a heat-generating member by heat transfer with vaporization to a refrigerant.

2. Description of the Related Art

As one of the prior arts, a cooling apparatus using latent heat of vaporization has been described in Japanese Unexamined Patent Publication (Kokai) No. 8-236669. As shown in FIG. 7, the cooling apparatus using latent heat of vaporization comprises a tubular refrigerant container 100 that stores a refrigerant therein and a heat radiating section 120 that cools the refrigerant vapor evaporated by receiving heat from a heat-generating member 110 attached to the surface of the refrigerant container 100, and the apparatus is used with the refrigerant container 100 in an almost upright position.

The refrigerant container 100 is equipped with a barrier 130 almost in the center in its sectional area and, thereby, is provided with a condensate path and a vapor path in order to promote circulation of the refrigerant to the condensate path, and the barrier 130 partitions the refrigerant container 100, so that the refrigerant vapor, in the vapor path, evaporated by receiving heat from the heat-generating member 110 is separated from the condensate that circulates in the condensate path after being cooled in the heat radiating section 120.

In the above-mentioned refrigerant container 100, however, heat conduction takes place through the barrier 130 and heat is transferred across the barrier 130, therefore, the refrigerant boils even in the condensate path through which the condensate circulates. As a result, the refrigerant vapor and the condensate that circulates from the heat radiating section 120 collide with each other, causing a malfunction of the refrigerant circulation and a problem that a sufficient improvement in performance of the cooling apparatus using latent heat of vaporization cannot be achieved.

SUMMARY OF THE INVENTION

The present invention has been developed with the above-mentioned circumstances taken into account and the objective is to provide a cooling apparatus using latent heat of vaporization that ensures excellent refrigerant circulation by the refrigerant vapor evaporated by receiving heat from the heat-generating member being separated from the condensate that circulates after being cooled in the heat radiating section and by preventing the heat transfer between the refrigerant vapor and the condensate in the refrigerant container.

The first aspect of the apparatus of the present invention

The cooling apparatus using latent heat of vaporization of the present invention comprises a refrigerant container, which stores a refrigerant therein and has an elongate tubular shape; wherein to the outer side surface of the refrigerant container a heat-generating member is attached; and wherein a heat radiating section, which is attached to the opposite outer side surface of the refrigerant container, cools the refrigerant vapor evaporated by receiving heat from the heat-generating member, and radiates heat. The apparatus is used with the outer side surface of the refrigerant container in an almost upright position; wherein the refrigerant container has a barrier that partitions the refrigerant container into two spaces which are a heat-generating member side path and a heat radiating section side path, so that the refrigerant vapor evaporated by receiving heat from the heat-generating member is separated from the condensate that circulates from the heat radiating section; and wherein the barrier has a heat insulating structure.

In this structure, as the heat transfer can almost be prevented by the barrier that has a heat insulating structure, it is possible to prevent the heat being transferred from the refrigerant vapor evaporated in the heat-generating member side path to the liquid refrigerant in the heat radiating section side path. As a result, it can be prevented that the condensate that circulates from the heat radiating section collides violently with the refrigerant vapor because the refrigerant in the heat radiating section side path is not evaporated, and an excellent refrigerant circulation can be ensured.

The second aspect of the apparatus of the present invention

In the cooling apparatus using latent heat of vaporization in the first aspect, the barrier includes a heat insulating space shut off from the internal space of the refrigerant container that stores the refrigerant. Due to this heat insulating space, a concrete heat insulating structure of the barrier can be realized.

The third aspect of the apparatus of the present invention

In the cooling apparatus using latent heat of vaporization in the second aspect, the heat insulating space provided in the barrier is maintained almost in a vacuum state. In this case, the heat transfer through the barrier can be considerably reduced because a good heat-insulating effect can be achieved.

The fourth aspect of the apparatus of the present invention

In the cooling apparatus using latent heat of vaporization in the second aspect, the heat insulating space provided in the barrier is communicated with the outside air. In this case, a heat insulating structure can be easily formed because it is not necessary to maintain the heat insulating space provided in the barrier in a hermetically sealed state.

The fifth aspect of the apparatus of the present invention

In the cooling apparatus using latent heat of vaporization of any one of the first through the fourth aspects, the refrigerant container has a multilayer structure in which plural plates are stacked, and an opening that forms a heat insulating space is provided in some plates.

In this structure, a heat insulating space can be formed, for example, by closing both the ends of the opening provided in a plate with neighboring plates. At this time, if the opening provided in a plate has a closed figure, a hermetically sealed heat insulating space can be formed and if the opening opens toward the exterior side of the plate, a heat insulating space communicated with outside air can be formed.

The sixth aspect of the apparatus of the present invention

In the cooling apparatus using latent heat of vaporization of any one of the first through the fifth aspects, two refrigerant containers that share one heat radiating section are provided.

In this case, it is possible to attach individual heat-generating members to each of two refrigerant containers for cooling by, for example, inserting and arranging a heat radiating section between the two refrigerant containers.

The seventh aspect of the apparatus of the present invention

A cooling apparatus boiling and condensing refrigerant, for cooling heat-generating member comprises: a refrigerant container, which stores refrigerant therein and a part of liquid refrigerant is boiled and vaporized by absorbing heat from the heat-generating member which attached on the first outer surface of refrigerant container, is disposed in an almost upright position, and a radiator, which is disposed onto the opposite outer surface of the refrigerant container, heat exchanges between refrigerant in the radiator and outside fluid passing through said radiator; wherein the refrigerant container has a first passage through which refrigerant vaporized by absorbing heat from the heat-generating member passes; and a second passage through which refrigerant cooled in the radiator and circulates from the radiator passes; and a partitioning member which partitions a part of refrigerant container into two spaces, which are the first passage and second passage; wherein the partitioning member has a heat insulating structure.

The present invention may be more fully understood from the description of the preferred embodiments of the invention set forth below, together with the accompanying drawings.

DESCRIPTION OF PREFERRED EMBODIMENTS

Next, the embodiments of the present invention will be described with reference to the drawings.

First Embodiment

Figure 1:
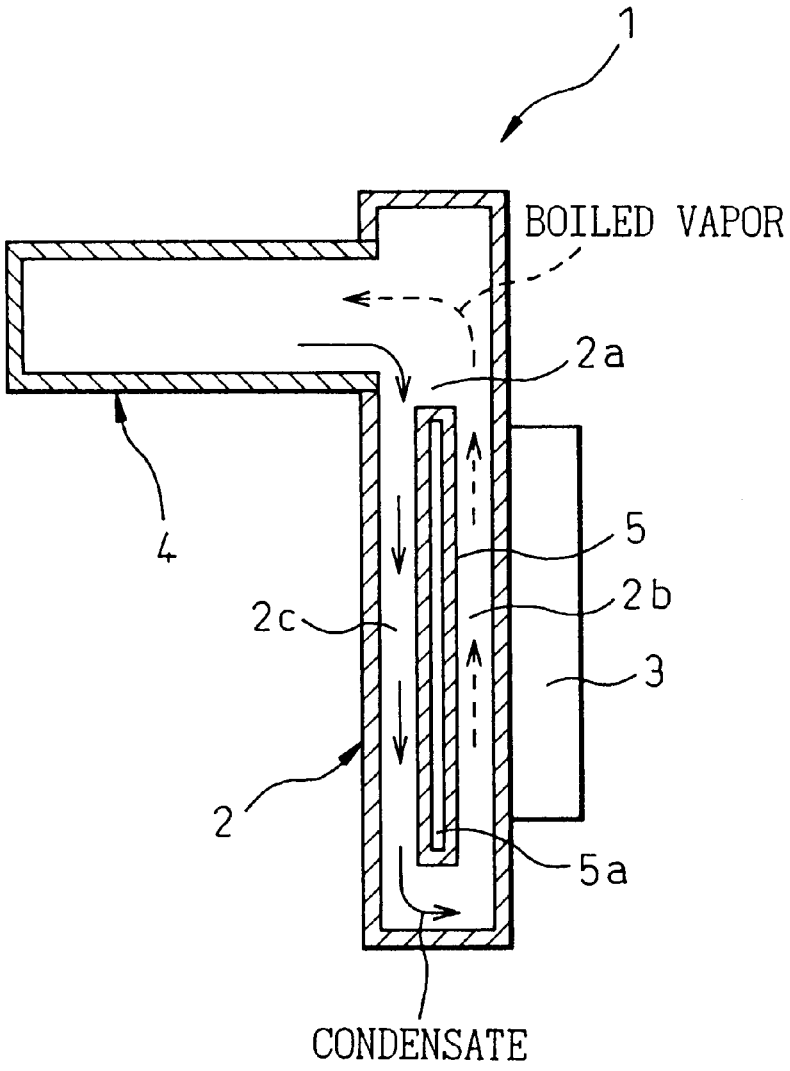
FIG. 1 is a sectional view (cross-section at A—A in FIG. 2) of a cooling apparatus using latent heat of vaporization (a first embodiment.)
Figure 2:
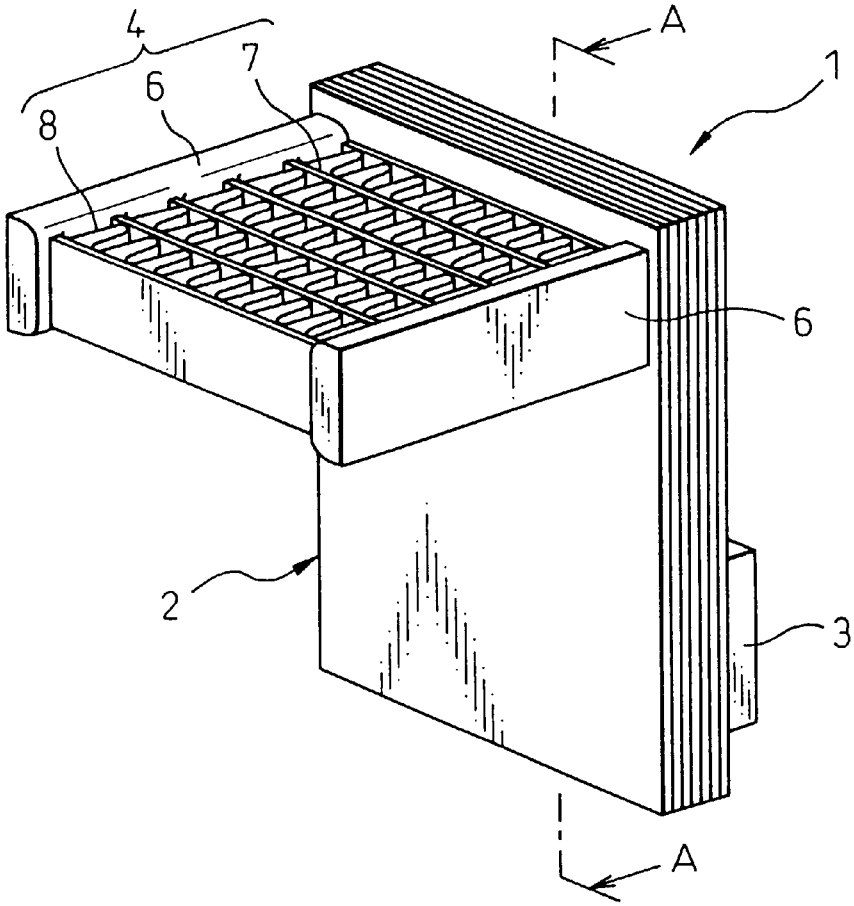
FIG. 2 is a perspective view of the cooling apparatus using latent heat of vaporization.

FIG. 1 is a sectional view of a cooling apparatus using latent heat of vaporization 1 and FIG. 2 is a perspective view of the cooling apparatus using latent heat of vaporization 1.

The cooling apparatus using latent heat of vaporization 1 in the present embodiment comprises a refrigerant container 2 that stores a refrigerant in an internal space 2*a* (refer to FIG. 1) and a heat radiating section 4 that cools the refrigerant vapor evaporated by receiving heat from a heat-generating member 3 attached to the refrigerant container 2, and the apparatus 1 is used in a state in which the heat-generating member 3 is attached to the outer side surface of the refrigerant container 2, which is almost upright, as shown in FIG. 1.

The refrigerant container 2 comprises a barrier 5 by which the refrigerant vapor evaporated by receiving heat from the heat-generating member 3 is separated from the condensate that circulates after being cooled in the heat radiating section 4 by partitioning part of its internal space 2*a* into a heat-generating member side path 2*b* and a heat radiating section side path 2*c* (in the horizontal direction in FIG. 1), as shown in FIG. 1. The barrier 5 includes a heat insulating space 5*a* the communication of which with the internal space 2*a*, that stores the refrigerant, being shut off.

The heat radiating section 4 comprises two headers 6, plural tubes 7 that communicate with the two headers 6, and heat radiating fins 8 attached to the surface of each tube 7, being in contact therewith, as shown in FIG. 2.

The two headers 6 are attached almost erectly onto an upper portion of the outer side surface of the refrigerant container 2, which is opposite to the heat-generating member 3 side, and are provided so as to communicate with the internal space 2*a* of the refrigerant container 2.

The tubes 7 are arranged almost in parallel to (or slightly inclined to) the surface of the refrigerant container 2, to which the headers 6 are attached, and communicate with the internal space 2*a* of the refrigerant container 2 via the two headers 6.

The heat radiating fin 8 is a well-known corrugated fin and used to increase the heat radiating area.

The cooling apparatus using latent heat of vaporization 1 described above is manufactured by, for example, being integrally brazed in a vacuum atmosphere after being assembled into a whole.

Next, the operations of the cooling apparatus using latent heat of vaporization 1 that has the above-mentioned structure will be described.

The refrigerant stored in the refrigerant container 2 is evaporated into vapor by receiving heat from the heat-generating member 3 mainly in the heat-generating member side path 2*b*, flows into one of the headers 6 from the refrigerant container 2, and flows distributively into each tube 7 from the header 6. The refrigerant vapor that has flowed into the tubes 7 is cooled by receiving a cooling air flow as it flows through the tubes 7, resulting in becoming condensate, and it circulates from the other header 6 to the heat radiating section side path 2*c* of the refrigerant container 2.

In this way, the heat generated in the heat-generating member 3 is transferred to the refrigerant, conveyed to the heat radiating section 4, in which the heat is released as latent heat of condensation when the refrigerant vapor is condensed, and radiated to the outside air via the heat radiating fins 8.

Effects of the first embodiment

In the refrigerant container 2 of the present embodiment, the barrier 5, by which the refrigerant vapor evaporated by receiving heat from the heat-generating member 3 is separated from the condensate that circulates to the heat radiating section side path 2*c* after being cooled in the heat radiating section 4, includes the heat insulating space 5*a*, therefore, heat transfer can be almost shut off by the barrier 5. As a result, an excellent refrigerant circulation can be ensured in which the refrigerant is prevented from boiling in the heat radiating section side path 2*c* and the condensate that circulates from the heat radiating section 4 and the refrigerant vapor do not collide violently with each other because it is possible to prevent the heat of the refrigerant vapor in the heat-generating member side path 2*b* from being transferred to the liquid refrigerant in the heat radiating section side path 2*c*.

Additionally, the heat insulating space 5*a* provided in the barrier 5 may be a hermetically sealed space or a space communicated with the outside air. In the case of the hermetically sealed space, a higher insulating effect can be obtained by maintaining the inside (the heat insulating space 5*a*) in an almost vacuum state (or a state filled with nitrogen).

Second Embodiment

Figure 3A:
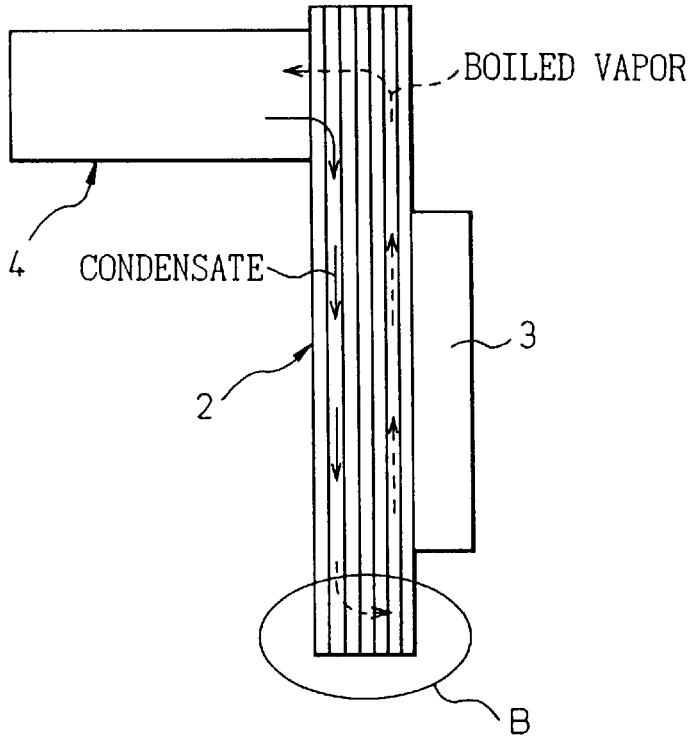
FIG. 3A is a side view of the cooling apparatus using latent heat of vaporization.

A refrigerant container 2 in the present embodiment has a multilayer structure in which plural plates 9 are stacked, as shown in FIG. 3.

The plural plates 9 are pressed materials punched out by a press die from, for example, aluminium or stainless plates, etc., and comprise two external plates 9A and 9B arranged on both external sides of the refrigerant container 2 and, for example, five intermediate plates 9C, 9D, and 9E that are interposed between both external plates 9A and 9B.

Figure 4A:
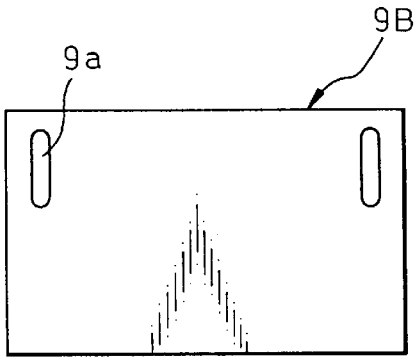
FIG. 4A is a plane view of a plate 9B (the second embodiment.)
Figure 4B:
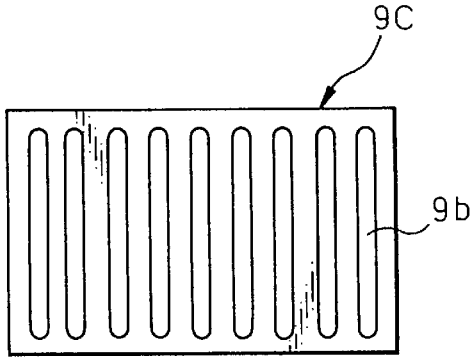
FIG. 4B is a plane view of a plate 9C (the second embodiment.)
Figure 4C:
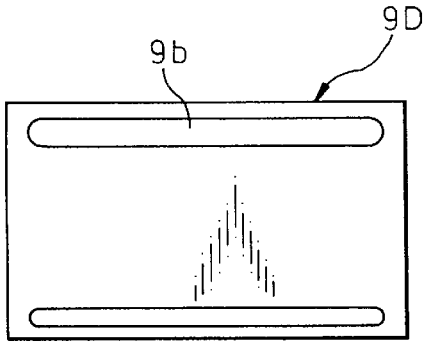
FIG. 4C is a plane view of a plate 9D (the second embodiment.)

The two external plates 9A and 9B are an external plate 9A (refer to FIG. 4E), onto the surface of which the heat-generating member 3 is attached, and an external plate 9B (refer to FIG. 4A), onto the surface of which the heat radiating section 4 is attached and, in the upper part of both the right and left ends of which a pair of openings 9*a*, into which the headers 6 (refer to FIG. 2) of the heat radiating section 4 are inserted, is formed.

The intermediate plates 9C to 9E are composed of the two types of the intermediate plates 9C and 9D in which slit-shaped openings 9*b* that form the internal space 2*a* of the refrigerant container 2 are formed, and the intermediate plate 9E in which an opening 9*c* that forms the heat insulating space 5*a* of the barrier 5, as well as the slit-shaped openings 9*b*, is formed.

Figure 3B:
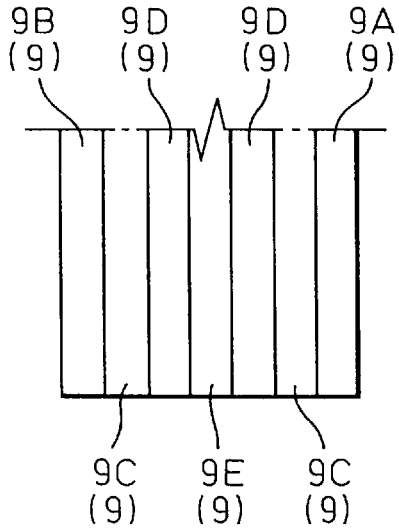
FIG. 3B is an enlarged view of part B (a second embodiment.)
Figure 4D:
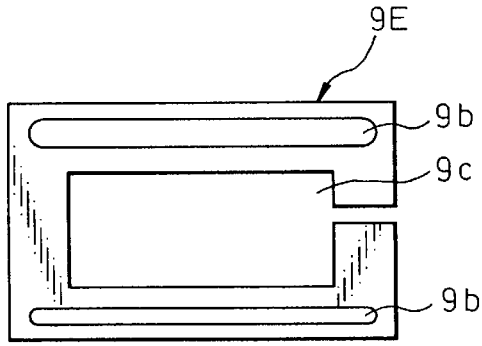
FIG. 4D is a plane view of a plate 9E (the second embodiment.)
Figure 4E:
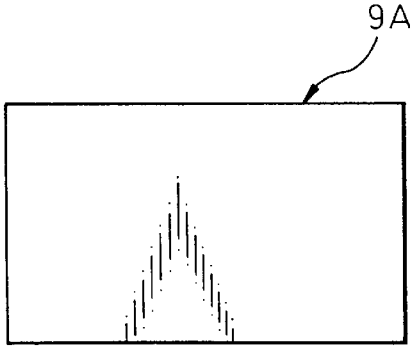
FIG. 4E is a plane view of a plate 9A (the second embodiment.)
Figure 4F:
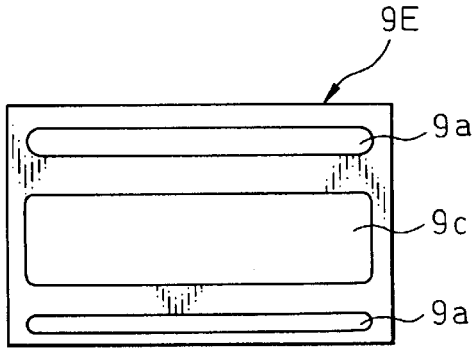
FIG. 4F is a plane view of a plate 9E (the second embodiment.)

If these plates 9 are stacked in the way shown in FIG. 3B, the heat insulating space 5*a* of the barrier 5 is formed by closing both surfaces of the opening 9*c* formed in the intermediate plate 9E with the other neighboring intermediate plates 9D. At this time, if the opening 9*c* is open toward the outside of the intermediate plate 9E, as shown in FIG. 4D, the heat insulating space 5*a* that is communicated with the outside air can be formed, and if the opening 9*c* provided in the intermediate plate 9E has a closed figure, as shown in FIG. 4F, the hermetically sealed heat insulating space 5*a* can be formed.

Figure 5A:
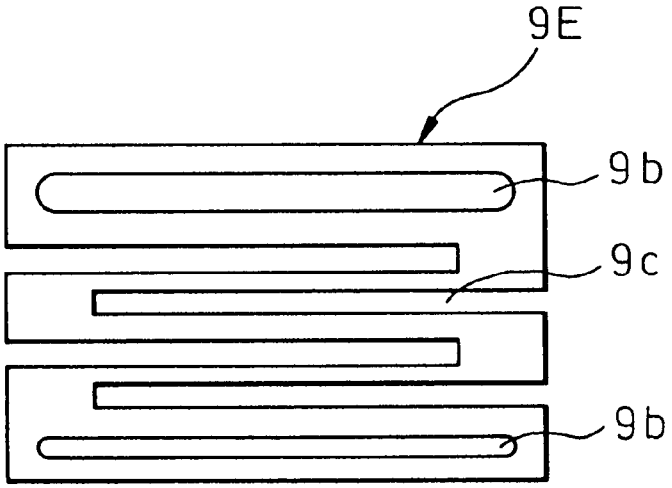
FIG. 5A is a plane view of a plate that forms a heat insulating space (the second embodiment.)
Figure 5B:
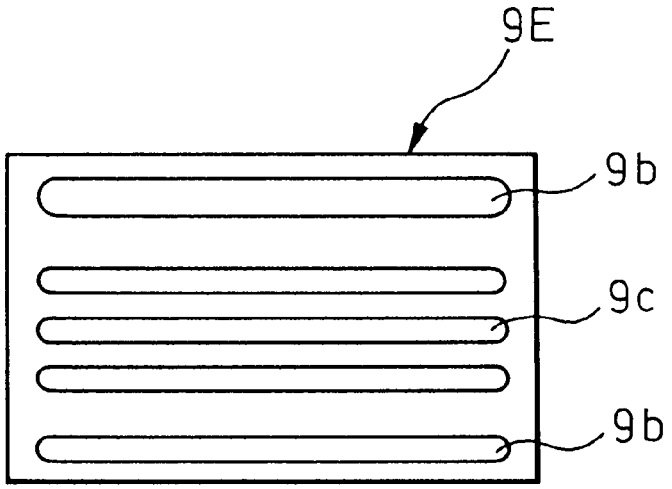
FIG. 5B is a plane view of a plate that forms the heat insulating space (the second embodiment.)

Moreover, the opening 9*c* that forms the heat insulating space 5*a* may be formed into a slit-shaped one, shown in FIG. 5A and FIG. 5B. In this case, the heat insulating space 5*a* divided into plural spaces is formed.

As described above, the multilayer structure of the refrigerant container 2 can make it easy to form the barrier 5 that has the heat insulating space 5*a*.

Additionally, ribs (not shown) can be formed when each plate 9 is stacked one by one so that the metal parts (part except openings) of plates 9 are successively connected in the direction of stacking. By providing the ribs as heat transfer ribs that transfer heat from the heat-generating member 3 to the barrier 5, it is possible to increase the heat transfer area. Moreover, by providing the ribs as reinforcement ribs that reinforce the two external plates 9A and 9B, the strength of the refrigerant container 2, against pressure, can be improved.

In addition, the capacity of the refrigerant container 2 can be changed by only increasing or decreasing the number of the plates 9, therefore, the volume (capacity) of the refrigerant container 2 can be easily changed according to an increase or decrease in the heat load, etc. In this case, even if the number of the plates 9 is to be increased, it is possible to respond to the modification at a very low cost because a new press die is not required.

Third Embodiment

The present embodiment is an example where two refrigerant containers 2A and 2B are provided for one heat radiating section 4.

Figure 6:
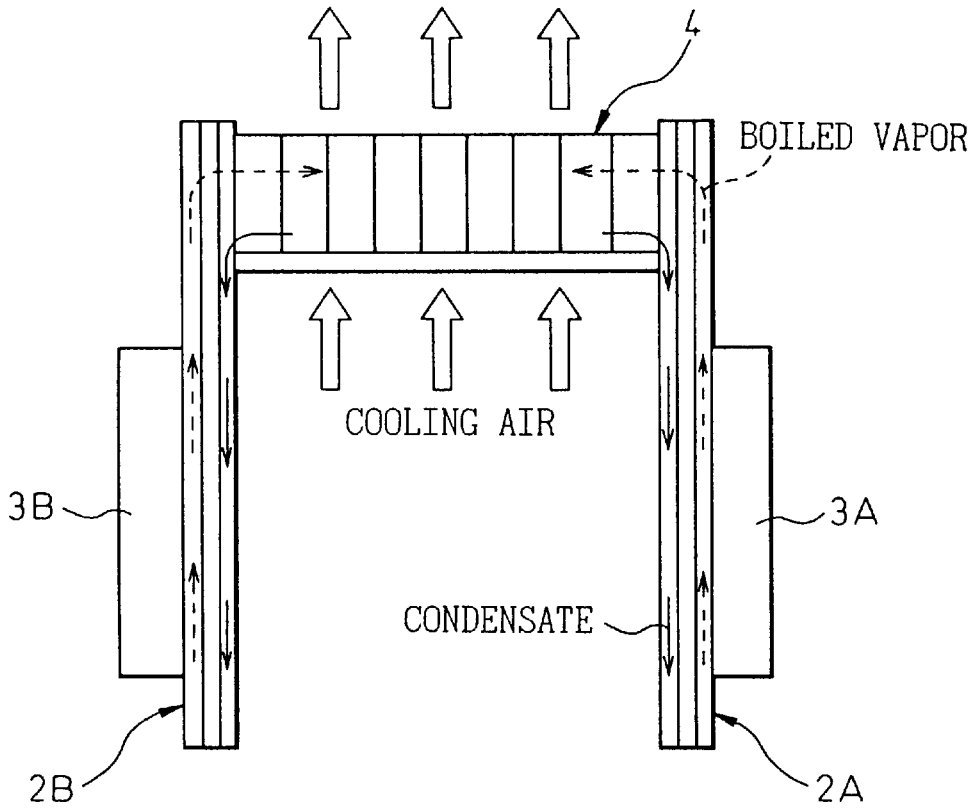
FIG. 6 is a side view of a cooling apparatus using latent heat of vaporization (a third embodiment.)
Figure 7:
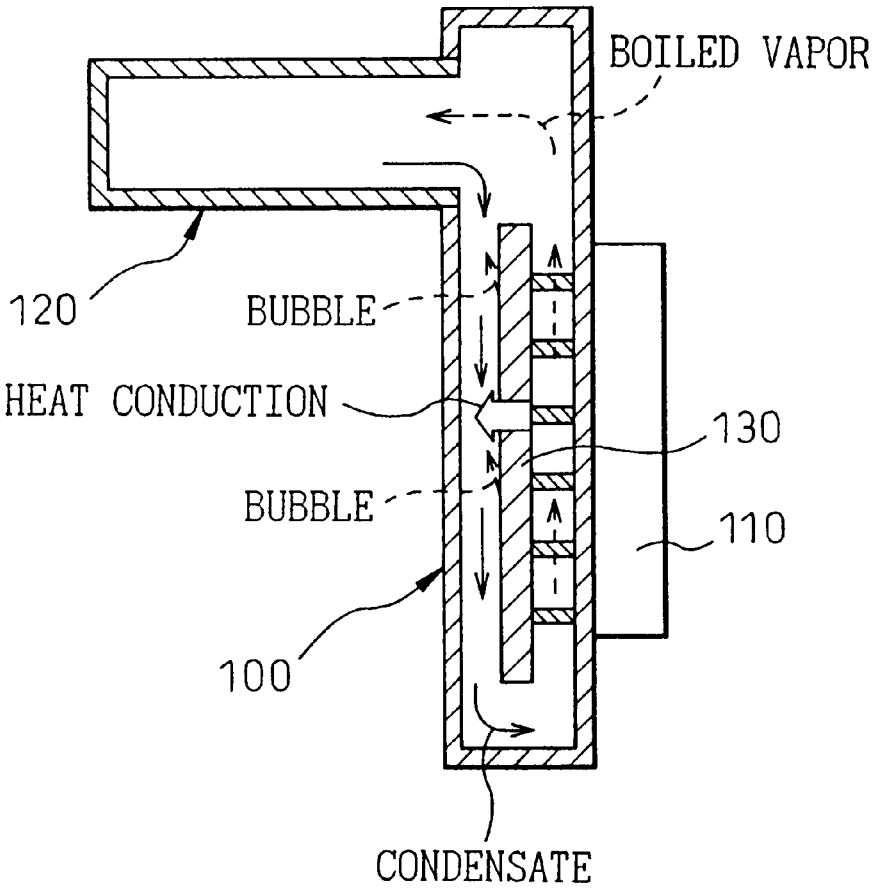
Fig.7 PRIOR ART
FIG. 7 is a sectional view of a cooling apparatus using latent heat of vaporization (prior art.)

In this case, for example, by interposing the heat radiating section 4 between the two refrigerant containers 2A and 2B, as shown in FIG. 6, it is possible to attach individual heat-generating members 3A and 3B to the refrigerant containers 2A and 2B, respectively, for cooling.

Additionally, the structure of the refrigerant containers 2A and 2B is the same as that in the first embodiment or the second embodiment, and the effect of preventing the interference between the refrigerant vapor and the liquid condensate in the individual refrigerant containers 2A and 2B is the same.

While the invention has been described by reference to specific embodiments chosen for the purposes of illustration, it should be apparent that numerous modifications could be made thereto by those skilled in the art without departing from the basic concept and scope of the invention.

What is claimed is:

1. A cooling apparatus boiling and condensing refrigerant comprising:

a refrigerant container which stores a liquid refrigerant in an internal space and has an elongate tubular shape;

a heat-generating member attached onto an outer side surface of the refrigerant container and cooled by the refrigerant container; and a heat radiating section which is attached onto an opposite outer side surface of the refrigerant container, cools refrigerant vapor evaporated by receiving heat from the heat-generating member, and radiates heat; wherein:

the outer side surface of the refrigerant container is disposed in an almost upright position;

the refrigerant container has a barrier that vertically partitions the refrigerant container into two spaces, which are a heat-generating member side path and a heat radiating side path, so that the refrigerant vapor evaporated by receiving heat from the heat-generating member is separated from condensate that circulates from the heat radiating section to the heat radiating side path; and the barrier has a heat insulating structure and has a surface substantially parallel to the outer side surface onto which the heat-generating member is attached.

2. A cooling apparatus boiling and condensing refrigerant, as set forth in claim 1, wherein the barrier comprises a heat insulating space shut off from the internal space of the refrigerant container that stores the liquid refrigerant.

3. A cooling apparatus boiling and condensing refrigerant, as set forth in claim 2, wherein the heat insulating space provided in the barrier is maintained almost in a vacuum state.

4. A cooling apparatus boiling and condensing refrigerant, as set forth in claim 2, wherein the heat insulating space provided in the barrier is in communication with the outside air.

5. A cooling apparatus boiling and condensing refrigerant, as set forth in claim 1, wherein the refrigerant container has a multilayer structure in which plural plates are stacked and at least openings that form heat insulating spaces are provided in at least one plate.

6. A cooling apparatus boiling and condensing refrigerant, as set forth in claim 1, wherein two refrigerant containers that share one heat radiating section are provided.

7. A cooling apparatus boiling and condensing refrigerant, as set forth in claim 1, wherein the heat-generating member side path and the barrier are disposed between the heat radiating side path and the outer side surface of the refrigerant container to which the heat-generating member is attached.

8. A cooling apparatus boiling and condensing refrigerant for cooling heat a heating-generating member, said cooling apparatus comprising:

a refrigerant container which stores liquid refrigerant therein and a part of the liquid refrigerant is boiled and vaporized by absorbing heat from the heat-generating member which is attached on a first outer surface of the refrigerant container, the first outer surface being disposed in an almost upright position; and a radiator, which is disposed onto an opposite outer surface of the refrigerant container, heat exchanges between refrigerant in the radiator and outside fluid passing through said radiator; wherein:

the refrigerant container has a first passage through which refrigerant vaporized by absorbing heat from the heat-generating member passes;

a second passage through which refrigerant cooled in the radiator and circulates from the radiator passes; and a partitioning member which partitions a part of the refrigerant container into the first passage and second passage; and wherein the partitioning member has a heat insulating structure and has a surface substantially parallel to the first outer surface onto which the heat-generating member is attached.

* * * * *